US010881195B2

(12) United States Patent
Nanda

(10) Patent No.: US 10,881,195 B2
(45) **Date of Patent: *Jan. 5, 2021**

(54) ILLUMINATED MULTI-LIGHT FLASHING TOOTHBRUSH AND METHOD OF USE

(71) Applicant: Children Oral Care, LLC, Buena Park, CA (US)

(72) Inventor: Puneet Nanda, Cerritos, CA (US)

(73) Assignee: Children Oral Care, LLC, Buena Park, CA (US)

( * ) Notice: Subject to any disclaimer, the term of this patent is extended or adjusted under 35 U.S.C. 154(b) by 143 days.

This patent is subject to a terminal disclaimer.

(21) Appl. No.: 15/973,304

(22) Filed: May 7, 2018

(65) Prior Publication Data

US 2018/0249816 A1 Sep. 6, 2018

Related U.S. Application Data

(63) Continuation of application No. 14/674,609, filed on Mar. 31, 2015, now Pat. No. 10,004,324, which is a (Continued)

(51) Int. Cl.

| | |
|---|---|
| ***A46B 15/00*** | (2006.01) |
| ***A46B 5/00*** | (2006.01) |
| ***A46B 9/04*** | (2006.01) |

(52) U.S. Cl.

CPC ..... *A46B 15/0044* (2013.01); *A46B 5/00* (2013.01); *A46B 9/04* (2013.01); *A46B 15/00* (2013.01);

(Continued)

(58) Field of Classification Search

CPC . A46B 15/00; A46B 15/0002; A46B 15/0004; A46B 15/0008; A46B 15/0036; A46B 15/0038; A46B 15/0044

(Continued)

(56) References Cited

U.S. PATENT DOCUMENTS

| | | | |
|---|---|---|---|
| 9,044,083 | B2 | 6/2015 | Nanda |
| 10,004,324 | B2 | 6/2018 | Nanda |

(Continued)

FOREIGN PATENT DOCUMENTS

| | | | |
|---|---|---|---|
| EP | 2884868 | | 6/2015 |
| EP | 3141148 | A1 | 3/2017 |
| WO | 2014028156 | A1 | 2/2014 |

OTHER PUBLICATIONS

Chinese Patent Appln. No. 201610920679.5—First Office Action dated May 9, 2018.

(Continued)

*Primary Examiner* — Mark Spisich

(74) *Attorney, Agent, or Firm* — Kane Kessler, P.C.; Paul E. Szabo

(57) ABSTRACT

A toothbrush with a handle having a base and a head and defining a cavity positioned between the base and the head. The toothbrush also includes a plurality of bristles attached to the head of the handle, a green light configured to flash for a first period of time and a red light configured to flash for a second period of time. The toothbrush also includes a switch coupled to the handle for activating the green light, and a circuit for automatically activating the red light after expiration of the first period of time.

19 Claims, 5 Drawing Sheets

Related U.S. Application Data continuation of application No. 13/844,118, filed on Mar. 15, 2013, now Pat. No. 9,044,083.

(60) Provisional application No. 61/683,566, filed on Aug. 15, 2012.

(52) U.S. Cl.
CPC ..... *A46B 15/0008* (2013.01); *A46B 15/0097* (2013.01); *A46B 2200/1066* (2013.01)

(58) Field of Classification Search
USPC ..... 15/105
See application file for complete search history.

(56) References Cited

U.S. PATENT DOCUMENTS

2006/0037158 A1* 2/2006 Foley ..... A46B 9/026 15/105
2007/0190509 A1 8/2007 Kim
2011/0067189 A1* 3/2011 Major ..... A46B 15/0002 15/106
2012/0137454 A1 6/2012 Huy et al.
2018/0249816 A1 9/2018 Nanda

OTHER PUBLICATIONS

Canadian Appln. No. 2,877,408—Canadian Office Action dated Nov. 22, 2019.
Chinese Patent Application No. 201610920679.5—Office Action dated Mar. 19, 2019.
Canadian Patent Application No. 2,877,408—Office Action dated Mar. 11, 2019.
Chinese Patent Application No. 2018101613538—First Office Action dated May 15, 2019.

* cited by examiner

ILLUMINATED MULTI-LIGHT FLASHING TOOTHBRUSH AND METHOD OF USE

CROSS REFERENCE TO RELATED APPLICATIONS

This application is a continuation of U.S. application Ser. No. 14/674,609, filed Mar. 31, 2015 now U.S. Pat. No. 10,004,324, which is a continuation of U.S. application Ser. No. 13/844,118, filed Mar. 15, 2013, now U.S. Pat. No. 9,044,083, which claims the benefit of and the priority of U.S. Provisional Application No. 61/683,566 filed on Aug. 15, 2012. The entirety of each of the above applications is herein incorporated by reference.

BACKGROUND

1. Field of the Invention

The present invention relates to dental hygiene, and more particularly to an illuminated multi-light flashing toothbrush and method of use.

2. Description of the Related Art

To ensure proper oral care, dentists recommend that we brush our teeth more than once a day for at least two to three minutes each time. Despite this recommendation, the average adult person does not brush his or her teeth for two to three minutes. This problem is worse with children, who have notoriously short attention spans and often view brushing their teeth as a chore. Accordingly, there is a general need for a device that encourages people, especially children, to brush their teeth more often and for longer periods of time.

SUMMARY OF THE INVENTION

According to some embodiments, a toothbrush may include a handle having a base and a head and defining a cavity positioned between the base and the head and a plurality of bristles attached to the head of the handle. The toothbrush may also include a number of lights that are configured to flash or illuminate for a set period of time. As an example, the lights may include a green light positioned in the cavity and configured to flash for a first period of time, a yellow light positioned in the cavity and configured to flash for a second period of time, and a red light positioned in the cavity and configured to flash for a third period of time. In one embodiment, the three lights are arranged along a vertical or longitudinal axis of the toothbrush to look similar to a traffic light. In some embodiments, the third period of time is less than the second period of time, which is less than the first period of time. The lights may be positioned along a longitudinal axis of the toothbrush with the green light being at the bottom, the yellow light being in the middle, and the red light being at the top, similar to a traffic light.

The toothbrush may also include a memory positioned in the cavity for storing the first period of time, the second period of time, and the third period of time. One or more batteries may be positioned in the cavity for powering the green light, the yellow light, the red light, and the memory. Alternatively, the lights may be white or clear lights where the lights have a green plastic cover, a yellow plastic cover, and a red plastic cover. A switch is coupled to the handle for activating the green light, and a circuit is coupled to the memory for automatically activating the yellow light after expiration of the first period of time and for automatically activating the red light after expiration of the second period of time.

In one embodiment, the first period of time is greater than 30 seconds and less than or equal to 90 seconds, the second period of time is greater than 10 seconds and less than or equal to 30 seconds, and the third period of time is less than or equal to 10 seconds. In one embodiment, the first period of time is greater than 15 seconds and less than or equal to 90 seconds, the second period of time is greater than 15 seconds and less than or equal to 90 seconds, and the third period of time is less than or equal to 10 seconds.

The green light, the yellow light and the red light do not flash at the same time. The green light indicates that the user should start and continue brushing using the toothbrush while the green light is flashing. After the first period of time expires, the green light stops flashing and the yellow light begins flashing. The flashing yellow light indicates to the user that he/she should continue brushing but the time period for brushing is about to come to an end. After the second period of time expires, the yellow light stops flashing and the red light begins flashing. Hence, the green light, the yellow light and the red light flash in a sequential order where the green light flashes first, the yellow light flashes second, and the red light flashes third. The rate of flashing for the lights can also be increased from the green light to the red light. For example, the green light flashes at a first rate, the yellow light flashes at a second rate, and the red light flashes at a third rate. The third rate being faster than the second rate and the second rate being faster than the first rate.

BRIEF DESCRIPTION OF THE DRAWINGS

The features and advantages of the embodiments of the present disclosure will become more apparent from the detailed description set forth below when taken in conjunction with the drawings. Naturally, the drawings and their associated descriptions illustrate example arrangements within the scope of the claims and do not limit the scope of the claims. Reference numbers are reused throughout the drawings to indicate correspondence between referenced elements.

DETAILED DESCRIPTION

In the following detailed description, numerous specific details are set forth to provide an understanding of the present disclosure. It will be apparent, however, to one of ordinarily skilled in the art that elements of the present disclosure may be practiced without some of these specific details. In other instances, well-known structures and techniques have not been shown in detail to avoid unnecessarily obscuring the present disclosure.

Figure 1:
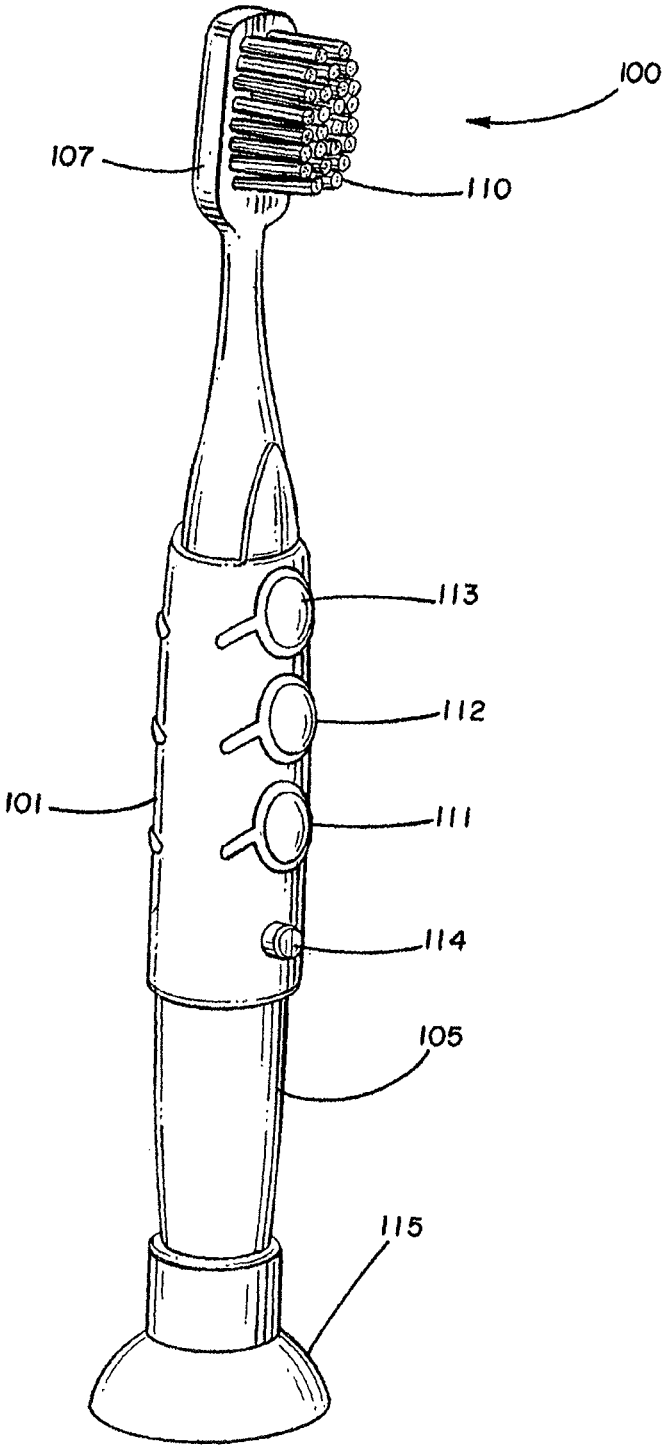
FIG. 1 is a perspective view of a multi-light flashing toothbrush according to an embodiment of the invention.

FIG. 1 is a perspective view of a multi-light flashing toothbrush 100 according to an embodiment of the invention. The toothbrush 100 includes a handle 105 having a base 115 and a head 107 and defining a cavity 116 (see FIGS. 7 and 8) positioned between the base 115 and the head 107 and a plurality of bristles 110 attached to the head 107 of the handle 105. The handle 105 can be made of a hard, clear plastic material. In various embodiments, the handle 105 can be made of a colored plastic material. In other embodiments, the handle 105 can be made of a translucent plastic material. The toothbrush 100 can also have a grip 101 made of a flexible rubber material. The grip 101 may cover the handle 105 and have an opening for each of the lights.

The handle 105 can be formed through an injection molding process. In such an embodiment, plastic in a liquid form can be injected into a mold having two sections. The liquid plastic can be injected into the mold where it is then allowed to solidify. When the mold is opened it creates the handle 105 having a brush side and a non-brush side.

The handle 105 can be generally cylindrical in shape and the base 115 can be a suction cup made of a rubber material. The plurality of bristles 110 can be embedded in the head 107 of the handle 105. In one embodiment, the plurality of bristles 110 can be made of a clear plastic material.

Figure 2:
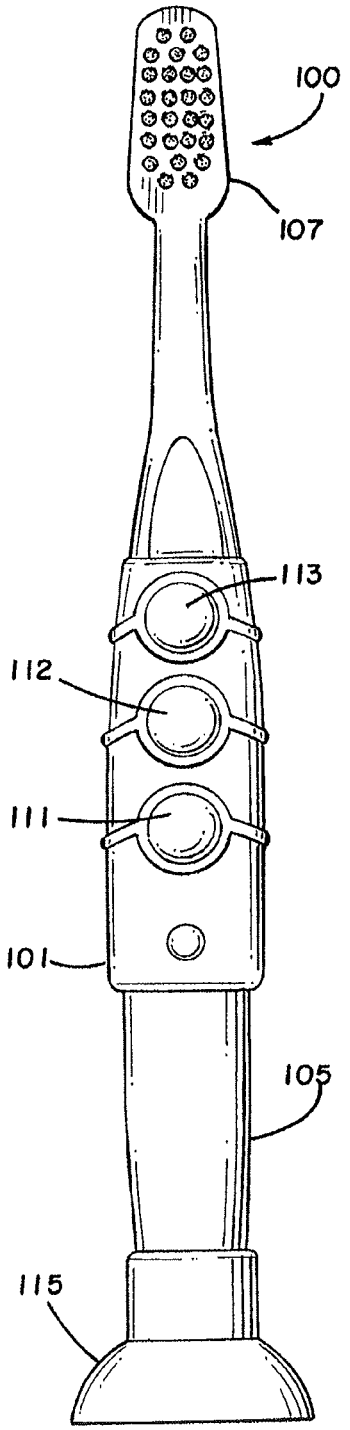
FIG. 2 is a front view of the multi-light toothbrush of FIG. 1 showing the brush side of the toothbrush according to an embodiment of the invention.
Figure 3:
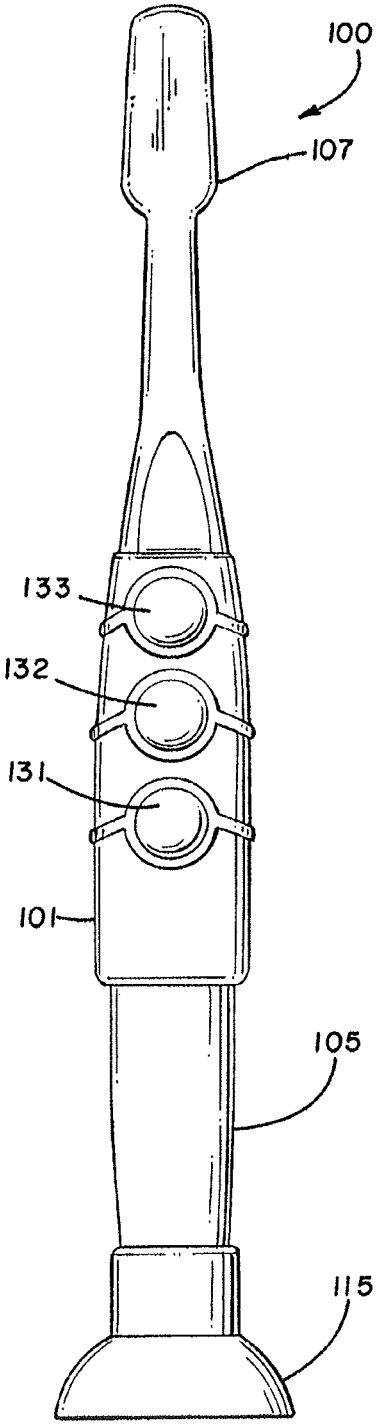
FIG. 3 is a rear view of the multi-light toothbrush of FIG. 1 showing the non-brush side of the toothbrush according to an embodiment of the invention.
Figure 4:
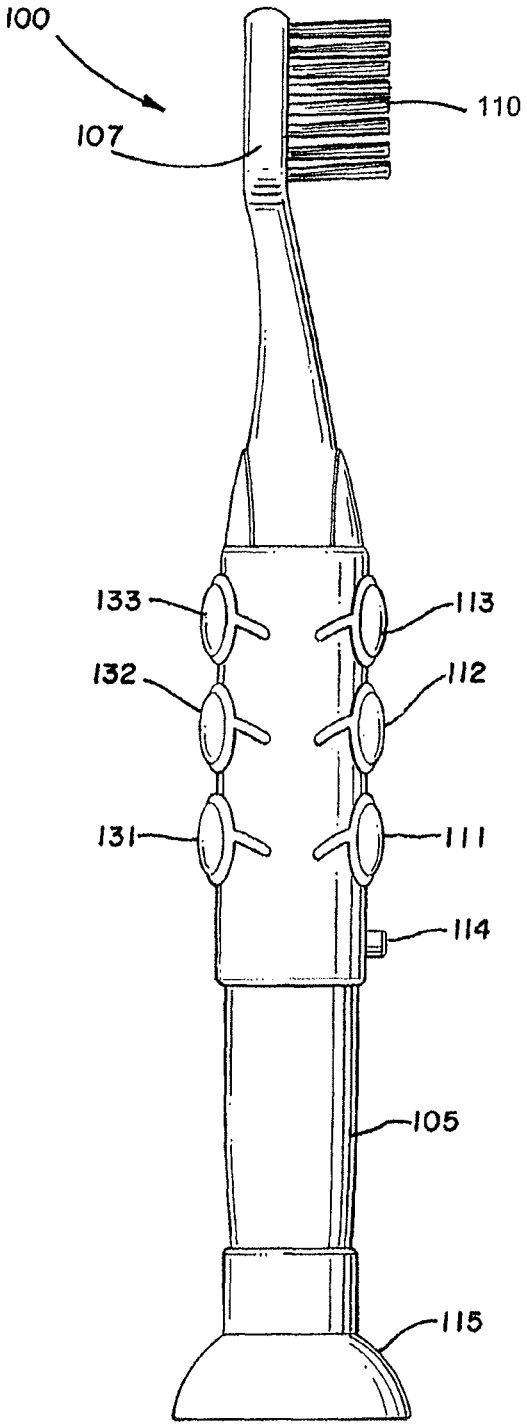
FIG. 4 is a side view of the multi-light toothbrush of FIG. 1 showing a front set of lights and a rear set of lights according to an embodiment of the invention.
Figure 8:
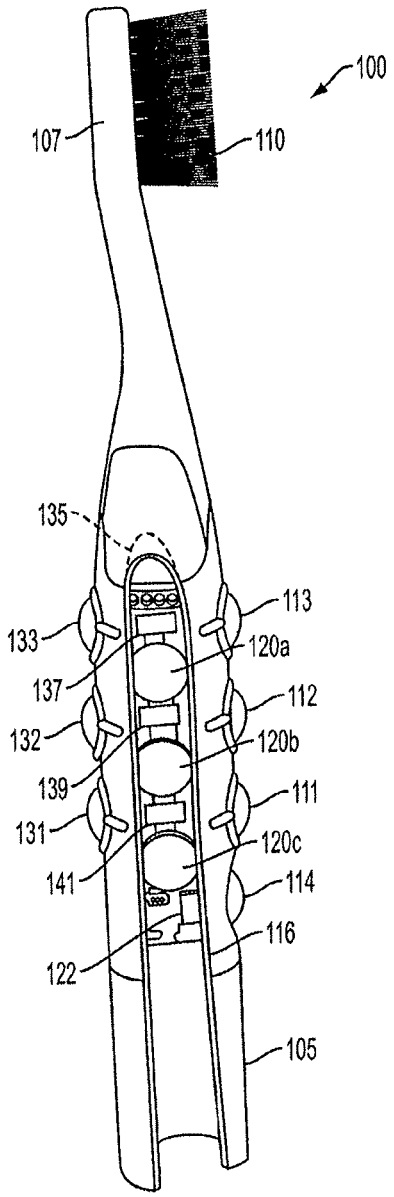
FIG. 8 is a cut-away perspective view of the multi-light toothbrush of FIG. 1 where electronic components located inside the toothbrush are shown according to an embodiment of the invention.

FIG. 2 is a front view of the multi-light toothbrush of FIG. 1 showing the brush side of the toothbrush, FIG. 3 is a rear view of the multi-light toothbrush of FIG. 1 showing the non-brush side of the toothbrush, and FIG. 4 a side view of the multi-light toothbrush of FIG. 1 showing a front set of lights and a rear set of lights. Referring to FIGS. 2-4, the toothbrush 100 includes a number of front lights (FIG. 2) that are configured to flash or illuminate for a set period of time, or a predetermined period of time, and includes a number of rear lights (FIG. 3) that are configured to flash or illuminate for a set period of time. As an example, each set of lights may include a green light 111 (131) positioned in the cavity and configured to flash for a first period of time, a yellow light 112 (132) positioned in the cavity and configured to flash for a second period of time, and a red light 113 (133) positioned in the cavity and configured to flash for a third period of time. The lights may be positioned along a longitudinal axis of the toothbrush with the green light 111 (131) being at the bottom, the yellow light 112 (132) being in the middle, and the red light 113 (133) being at the top, similar to a traffic light. The green light 111 (131), the yellow light 112 (132), and the red light 113 (133) may be interchanged in arrangement and position while still maintaining the spirit and scope of the present invention. For example, the green light 111 (131) may be positioned at the top, the yellow light 112 (132) may be positioned in the middle, and the red light 113 (133) may be positioned at the bottom. The lights may include a plurality of components including a cover (the items marked with reference numbers 111, 112, 113, 131, 132 and 133) and a lighting device that produces or generates the light. The lighting device may comprise any device that produces or generates light, including incandescent light bulb devices, solid state devices, or any other device known in the art that may provide illumination. FIG. 8, for example, illustrates lighting devices in the form of light emitting diodes (LEDs) 137, 139, 141 that are positioned between respective covers 113 and 133, 112 and 132, and 111 and 131.

In one embodiment, the handle 105 may be made of a translucent plastic material such that light rays or beams from each light travel through the entire handle 105 and accordingly light up the entire handle 105 with the color of the light that is flashing. For example, when the green light 111 (131) is flashing, the green light also travels through the handle 105 to light up the entire handle 105 (including the bristles 110) with the color green. When the yellow light 112 (132) is flashing, the yellow light also travels through the handle 105 to light up the entire handle 105 (including the bristles 110) with the color yellow. When the red light 113 (133) is flashing, the red light also travels through the handle 105 to light up the entire handle 105 (including the bristles 110) with the color red.

Alternatively, the green light 111 can be flashing while the green light 131 can be continuously on to light up the handle 105 with the color green. The yellow light 112 can be flashing while the yellow light 132 can be continuously on to light up the handle 105 with the color yellow. The red light 113 can be flashing while the red light 133 can be continuously on to light up the handle 105 with the color red.

Figure 5:
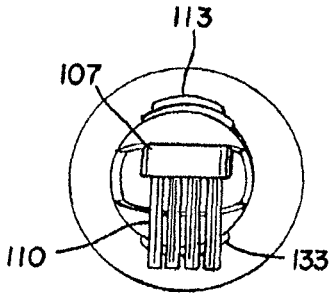
FIG. 5 is a top view of the multi-light toothbrush of FIG. 1 according to an embodiment of the invention.
Figure 6:
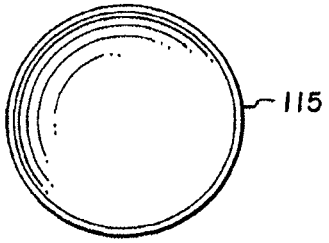
FIG. 6 is a bottom view of the multi-light toothbrush of FIG. 1 according to an embodiment of the invention.

FIG. 5 is a top view of the multi-light toothbrush of FIG. 1 and FIG. 6 is a bottom view of the multi-light toothbrush of FIG. 1. In one embodiment, the switch 114 may be positioned at the base 115. The switch 114 may be positioned at the center of the base 115 and may be activated by an individual pressing the switch 114 inwards toward the interior of the toothbrush 100. The switch 114 may be positioned at the center of a suction cup comprising the base 115.

Figure 7:
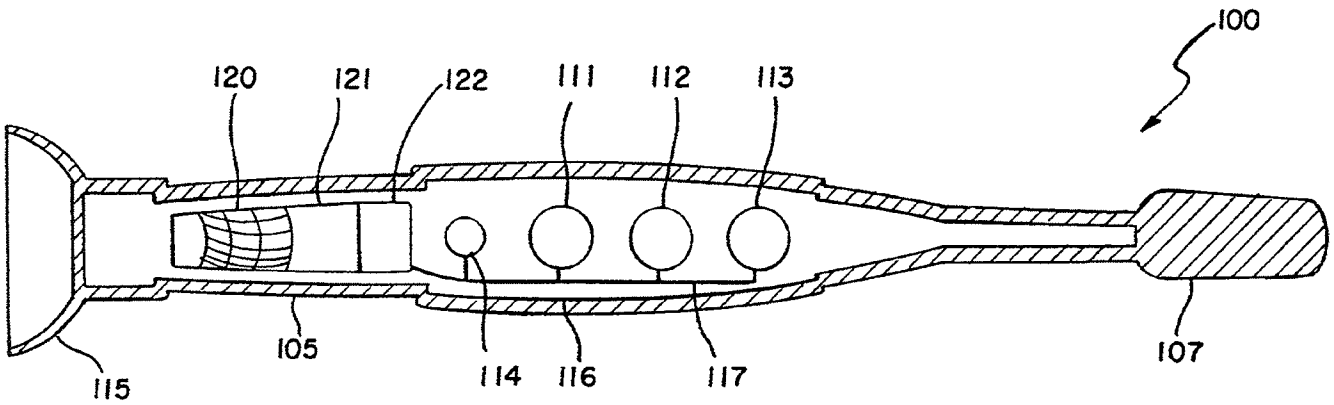
FIG. 7 is a cross-sectional schematic view of the multi-light toothbrush of FIG. 1 where the electronic components located inside the toothbrush are shown according to an embodiment of the invention.

FIG. 7 is a cross-sectional view of the multi-light toothbrush of FIG. 1 where the electronic components located inside the toothbrush 100 are shown according to an embodiment of the invention. The inside surface defines the cavity 116. The cavity 116 can serve as a housing for the batteries 120, the memory 121, and the timing or illumination circuit 122. The switch 114, the batteries 120, the memory 121, the timing circuit 122, the first light 111 (131), the second light 112 (132), and the third light 113 (133) are positioned in the cavity 116 and are electrically connected together using a plurality of wires or cables 117, or other electrical conduits. The memory 121 is used to store the first period of time, the second period of time, and the third period of time. One or more batteries 120 may be positioned in the cavity 116 for powering the switch 114, the memory 121, the timing circuit 122, the green light 111 (131), the yellow light 112 (132), and the red light 113 (133). Alternatively, the lights may be white or clear lights where the lights have a green plastic cover, a yellow plastic cover, and a red plastic cover.

The switch 114 is connected to the timing circuit 122 for activating the green light 111 (131) for the first period of time, and the timing circuit 122 is coupled to the memory 121 for automatically activating the yellow light 112 (132) after expiration of the first period of time and for automatically activating the red light 113 (133) after expiration of the second period of time. The switch may comprise a button, a lever, another form of electrical or mechanical switching device, or the like. The switch 114 may be variably positioned on the toothbrush 100, for example at or near the base 115 or the head 107, or at another position on or within the toothbrush 100. In one embodiment, the switch 114 may comprise a water sensor that activates when the toothbrush 100 becomes wet, to indicate that brushing is about to begin.

In one embodiment, the switch 114 may comprise a motion sensor to detect tilt of the toothbrush 100 (e.g., the individual is moving the brush to the mouth) or detect grip of the toothbrush 100 (e.g., the individual is grabbing the brush to start brushing).

Upon the switch 114 being activated, the timing circuit 122 may retrieve the first period of time, the second period of time, and the third period of time from the memory 121 and controls the starting of each period of time, the starting and stopping of the flashing (including rate of flashing) of each light, and the stopping or resetting of each period of time. The memory may comprise a programmable memory or a dedicated analog or digital memory. In one embodiment, the memory 121 may comprise dedicated analog circuitry that timing circuit 122 activates to automatically apply a duration of time to the lights. The timing circuit 122 can function to illuminate the lights for the stored period of time, or a predetermined period of time. The timing circuit 122 also preferably can serve to control the lights to blink intermittently for the periods of time in which it is engaged. In some embodiments, the lights may stay on continuously and/or illuminate for a longer or shorter period of time. In the illustrated embodiment, the timing circuit 122 is activated by closing the switch 144 to complete a circuit. The timing circuit 122 may comprise dedicated digital or analog circuitry, including an integrated circuit. In one embodiment, the circuit 122 may comprise a processor.

In one embodiment, the first period of time is greater than 30 seconds and less than or equal to 90 seconds, the second period of time is greater than 10 seconds and less than or equal to 30 seconds, and the third period of time is less than or equal to 10 seconds. In one embodiment, the first period of time is greater than 15 seconds and less than or equal to 90 seconds, the second period of time is greater than 15 seconds and less than or equal to 90 seconds, and the third period of time is less than or equal to 10 seconds. In one embodiment, the first period of time may be identical to the second period of time. In one embodiment, the first period of time may be approximately 30 seconds, the second period of time may be approximately 30 seconds, and the third period of time may be approximately 5 seconds. In other embodiments, the durations may be varied as desired.

The green light 111 (131), the yellow light 112 (132) and the red light 113 (133) do not flash at the same time. The flashing green light 111 (131) indicates that the user (i.e., the person brushing his or her teeth) should start and continue brushing using the toothbrush 100 while the green light 111 (131) is flashing. After the first period of time expires, the green light 111 (131) stops flashing and the yellow light 112 (132) begins flashing. The flashing yellow light 112 (132) indicates to the user that he/she should continue brushing but the time period for brushing is about to come to an end. After the second period of time expires, the yellow light 112 (132) stops flashing and the red light 113 (133) begins flashing. Hence, the green light 111 (131), the yellow light 112 (132) and the red light 113 (133) flash in a sequential order where the green light 111 (131) flashes first, the yellow light 112 (132) flashes second, and the red light 113 (133) flashes third. The timing circuit 122 may control the sequence that the colored lights flash. The timing circuit 122 may be configured to turn on the green light 111 (131) after the switch 114 is activated and turn off the green light 111 (131) after the first predetermined period of time elapses, then to turn on the yellow light 112 (132) and turn off the yellow light 112 (132) after the second predetermined period of time elapses, then to turn on the red light 113 (133) and turn off the red light 113 (133) after the third predetermined period of time elapses, with the green light 111 (131), the yellow light 112, and the red light 113 (133) not being on at the same time. The toothbrush 100 displays one color and then displays another color in sequence. In one embodiment, the next light in the sequence may be activated nearly instantaneously after the prior period of time elapses, preferably the next light in the sequence is activated no more than one second after the prior period of time elapses. In one embodiment, the timing circuit 122 may be configured to allow the green light 111 (131) to flash again, after the red light 113 (133) has completed flashing, only after the switch 114 is activated again. The respective colored lights may flash or remain continuously on during the respective period of time they are activated. In one embodiment, once the third period of time expires, the red light 113 (133) may shut off or turn on (without flashing) for a fourth period of time where the red light 113 (133) remains continuously on to indicate that it is time to stop brushing.

The rate of flashing for the lights can also be increased from the green light 111 (131) to the red light 113 (133) and vice versa. For example, the green light 111 (131) may flash at a first rate, the yellow light 112 (132) may flash at a second rate, and the red light 113 (133) may flash at a third rate. The third rate being faster than the second rate and the second rate being faster than the first rate.

The frequency of blinking can remain constant, or vary in frequency. In some embodiments, the frequency can increase as the time approaches 60, 90 or 120 seconds. In some embodiments, the frequency can remain constant through a first period of time, and increase in frequency in a second period of time. In one example, the frequency can remain constant for approximately 45 seconds, then increase for the remaining 15 seconds. In other embodiments, different time intervals can be used, such as, for example, two even periods of thirty seconds each. Various rates of flashing and time intervals may be utilized as desired. Instead of three lights on each side, two or four lights may be used. For example, two lights such as a green light and a red light may be used. In one embodiment, one of the green light or red light may be positioned at or near the base 115 of the toothbrush 100, and the other one of the green light or red light may be positioned towards the head 107 of the toothbrush.

FIG. 8 illustrates a cut-away perspective view of the multi-light toothbrush of FIG. 1 where electronic components located inside the toothbrush 100 are shown. The base 115 has been removed. The electronic components inside the toothbrush 100 may include a circuit board upon which the lighting devices in the form of LEDs 137, 139, 141, the timing circuit 122, and batteries 120*a*, 120*b* and 120*c* may be positioned. The memory 121 (not shown) may also be positioned upon the circuit board. An LED 135 may be positioned at one end of the circuit board.

The timing circuit 122 may be positioned to directly engage the switch 114 such that the timing circuit 122 detects activation of the switch 114 and is able to cause one or more of the lights, for example, a light in the form of LED 141 and covers 111, 131, to become activated. Electrical conduits may connect the timing circuitry 122 to the switch 114, and each of the LEDs 141, 139, 137 to allow the timing circuitry 122 to operate the LEDs 141, 139, 137 when the switch 114 is activated. The timing circuitry 122 may be powered by one or more of batteries 120*a*, 120*b*, 120*c*.

The LEDs 137, 139, 141 may comprise components of lights, or may comprise the only component of a light. For example, in the embodiment shown in FIG. 8, the LED 137 is used in conjunction with and is positioned between covers 113 and 133. The LED 137, when turned "on," will produce light that is emitted and passed through both of the covers 113 and 133. The LED 137 will not produce light when turned "off." The LED 137 may be configured to produce red light directly from the diode surface, or may produce red light via a coating on the diode surface. In one embodiment, the covers 113 and 133 may not be colored, and the LED 137 may be colored. In one embodiment, the LED 137 may comprise a white light emitting diode, and one or more of the covers 113 and 133 may be configured to color the white light so that it is emitted green from the covers 113 and 133. The light including LED 139 and covers 112 and 132 may be configured similarly as described above in various embodiments to emit yellow light. The light including LED 141 and covers 111 and 131 may be configured similarly as described above in various embodiments to emit red light.

The LEDs 137, 139, 141 are positioned in line with one another along the longitudinal axis of the toothbrush 100, such that an axis may extend through the LEDs 137, 139, 141. Each LED 137, 139, 141 may be positioned between respective covers (111 and 131, 112 and 132, 113 and 133) such that light emitted from the LED 137, 139, 141 passes through the respective covers.

In other embodiments, the LEDs 137, 139, 141 may extend through the outer surface of the toothbrush 100. In other embodiments, the LEDs 137, 139, 141 may be positioned exterior to the outer surface of the toothbrush handle 105. In other embodiments, the covers 111, 112, 113, 131, 132, 133 may not be utilized and the LEDs 137, 139, 141 may be exposed to the environment outside of the toothbrush 100. In other embodiments, the LEDs 137, 139, 141 may be variably coupled to the toothbrush 100, for example the LEDs 137, 139, 141 may be positioned at or near the base 115 (shown in FIG. 7), the head 107, or elsewhere on or along the handle 105. Any number of other lights may be may be variably coupled to the toothbrush 100, for example, positioned at or near the base 115 (shown in FIG. 7), the head 107, or elsewhere on or along the handle 105, to produce the intended lighting result. In other embodiments, multiple numbers of LEDs colored as desired may be used to produce an intended lighting effect.

In other embodiments, the LEDs 137, 139, 141 may replaced by other kinds of lighting devices as desired. Preferably, however, the LEDs 137, 139, 141 are utilized based on their longevity, low power consumption, durability, water resistance, and ability to produce a variety of colors of light.

The batteries 120*a*, 120*b*, 120*c* are positioned between the LEDs to power the LEDs 137, 139, 141. Each battery 120*a*, 120*b*, 120*c* may be configured to power a respective LED 137, 139, 141. For example, the battery 120*a* may be dedicated to power the nearby LED 137, the battery 120*b* may be dedicated to power nearby LED 139, and battery 120*c* may be dedicated to power nearby LED 141. Any or all of the batteries 120*a*, 120*b*, 120*c* may be used to power the remaining electrical components of the toothbrush 100. The use of multiple batteries 120*a*, 120*b*, 120*c* may beneficially allow for extended life of the lights. In addition, the use of multiple batteries 120*a*, 120*b*, 120*c* positioned in line along the circuit board may allow the total diameter of the toothbrush 100 to be reduced and more easily fit within a child's hand. In other embodiments, a single battery may be used to power all electrical components. In other embodiments, other forms of batteries or power sources may be utilized, including a capacitor, a solar powering cell, an inductive circuit that stores power, or other devices for storing energy. In other embodiments, the toothbrush 100 may be plugged into a wall socket or other power source to draw power.

The LED 135 that is shown at one end of the circuit board may be used for illumination of the interior of the toothbrush 100 and/or for providing further light that passes through the outer surface of the toothbrush 100. In one embodiment, the LED 135 may comprise a single LED configured to produce multiple colors, for example a green, yellow, and red color. The LED 135 may comprise a multi-colored LED. The color produced may vary based on whether a green light, yellow light, or red light is activated at that time. For example, the LED 135 may produce green light when a green light (111, 131, 141) is activated. The LED 135 may produce yellow light when a yellow light (139, 112, 132) is activated. The LED 135 may produce red light when a red light (137, 113, 133) is activated. The LED 135 may serve to increase the overall amount of colored light emitted from the toothbrush 100 at a defined time.

In other embodiments, the LED 135 may be configured to produce a color of light that is different than the light emitted from lights (111, 131, 141), (139, 112, 132), (137, 113, 133), and/or at a different time. In other embodiments, multiple LEDs 135 may be used to emit light from the toothbrush 100.

In other embodiments, the LEDs 141, 139, 137 may comprise multi-colored LEDs. The multi-colored LEDs may be configured to produce colored light in the same manner and sequence as discussed in this application. However, rather than have a dedicated green light, yellow light and red light, a single or multiple multi-colored LEDs may produce the desired color of light. In one embodiment, a single multi-colored LED may comprise the green light, yellow light and red light. In one embodiment, multiple multi-colored LEDs may be used in an equivalent manner to comprise the green light, yellow light and red light. In other embodiments, a multi-colored LED or LEDs may be configured to produce a various numbers of colors, for example, a multi-colored LED may be configured to produce two colors, three colors, or four colors. The multi-colored LED may be configured to only produce green and red light. In one embodiment, one multi-colored LED may be positioned near the base 115 of the toothbrush 100 and one multi-colored LED may be positioned near the head 107 of the toothbrush. One of the LEDs may produce red light and the other may produce green light. The location, number, and kind of lights utilized to produce the intended lighting effect may be varied as desired.

Those of ordinary skill will appreciate that the various illustrative logical blocks and process steps described in connection with the examples disclosed herein may be implemented as electronic hardware, computer software, or combinations of both. Whether such functionality is implemented as hardware or software depends upon the particular application and design constraints imposed on the overall system. Ordinarily skilled artisans may implement the described functionality in varying ways for each particular application, but such implementation decisions should not be interpreted as causing a departure from the scope of the disclosed apparatus and methods.

Systems, methods and products are provided. References to "various embodiments", in "some embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

The foregoing description of the disclosed example embodiments is provided to enable any person of ordinary skill in the art to make or use the present invention. Various modifications to these examples will be readily apparent to those of ordinary skill in the art, and the principles disclosed herein may be applied to other examples without departing from the spirit or scope of the present invention. The described embodiments are to be considered in all respects only as illustrative and not restrictive and the scope of the invention is, therefore, indicated by the following claims rather than by the foregoing description. All changes which come within the meaning and range of equivalency of the claims are to be embraced within their scope.

What is claimed is:

1. A toothbrush comprising:

a handle;

a plurality of bristles coupled to the handle;

a first light configured to produce light that is visible from outside the handle with a green color to indicate to a user when to brush the user's teeth;

a second light configured to produce light that is visible from outside the handle with a red color to indicate to the user when to cease brushing the user's teeth;

a switch configured to be pressed to cause the first light to turn on for a first predetermined period of time; and a circuit configured to turn on the first light only when the switch is pressed, then to automatically turn off the first light after the first predetermined period of time elapses, then to automatically turn on the second light, and then to automatically turn off the second light after a second predetermined period of time elapses, the second predetermined period of time being shorter than the first predetermined period of time, and the first light not being then automatically turned on again after the second predetermined period of time elapses:

further comprising a front green-light window, a front red-light window, a rear green-light window, and a rear red-light window located along the handle, wherein the handle has a front side and a back side opposite the front side, the plurality of bristles being located on the front side, and wherein the front green-light window and the front red-light window are located on the front side and the rear green-light window and the rear red-light window are located on the back side.

2. The toothbrush of claim 1, wherein the first light is configured to flash when the first light is turned on.

3. The toothbrush of claim 1, wherein the second light is configured to flash when the second light is turned on.

4. The toothbrush of claim 1, wherein the handle extends along a longitudinal axis and the first light and the second light are each positioned along the axis to resemble a traffic light.

5. The toothbrush of claim 1, wherein the circuit is configured to control the second light such that the second light is automatically turned off without the switch being pressed.

6. The toothbrush of claim 1, wherein the first predetermined period of time is greater than 15 seconds and less than or equal to 90 seconds.

7. The toothbrush of claim 1, wherein the circuit is configured to operate the first light and the second light such that the first light and the second light are not on at the same time.

8. The toothbrush of claim 1, further comprising:

a memory for storing the first predetermined period of time and the second predetermined period of time; and a battery for powering the first light, the second light, and the memory.

9. The toothbrush of claim 1, wherein the handle includes a base on an end of the handle opposite the bristles, and wherein neither the first light nor the second light are located in the base.

10. A toothbrush comprising:

a handle having a base and a head;

one or more lights configured to produce light that is visible from outside the handle with a green color, and to produce light that is visible from outside the handle with a red color;

a switch configured to be pressed to cause the one or more lights to produce light that is visible from outside the handle with the green color for a first predetermined period of time; and a circuit configured to control the one or more lights such that the one or more lights produce the green color only when the switch is pressed, then to stop producing the green color after the first predetermined period of time elapses, and then produce the red color for a second predetermined period of time, and then stop producing the red color after the second predetermined period of time elapses, the second predetermined period of time being shorter than the first predetermined period of time, and the one or more lights not automatically producing the green color again after the second predetermined period of time elapses;

further comprising a front green-light window, a front red-light window, a rear green-light window, and a rear red-light window located along the handle, wherein the handle has a front side and a back side opposite the front side, a plurality of bristles being located on the front side, and wherein the front green-light window and the front red-light window are located on the front side and the rear green-light window and the rear red-light window are located on the back side.

11. The toothbrush of claim 10, wherein the one or more lights are configured to flash when the one or more lights produce light with the green color.

12. The toothbrush of claim 10, wherein the one or more lights are configured to flash when the one or more lights produce light with the red color.

13. The toothbrush of claim 10, wherein the one or more lights include a first light configured to produce the green color, and a second light configured to produce the red color.

14. The toothbrush of claim 13, wherein the handle extends along a longitudinal axis and the first light and the second light are each positioned along the axis to resemble a traffic light.

15. The toothbrush of claim 13, wherein the circuit is configured to operate the first light and the second light such that the first light and the second light are not on at the same time.

16. The toothbrush of claim 10, wherein the circuit is configured to control the one or more lights such that the one or more lights stop producing the red color without the switch being pressed.

17. The toothbrush of claim 10, wherein the first predetermined period of time is greater than 15 seconds and less than or equal to 90 seconds.

18. The toothbrush of claim 10, further comprising:

a memory for storing the first predetermined period of time and the second predetermined period of time; and a battery for powering the one or more lights and the memory.

19. The toothbrush of claim 10, wherein none of the one or more lights are located in the base.

* * * * *